United States Patent [19]

Tichy

[11] Patent Number: 4,597,722

[45] Date of Patent: Jul. 1, 1986

[54] LONG-STROKE DOWNHOLE PUMP

[76] Inventor: James B. Tichy, P.O. Box 1308, Sausalito, Calif. 94966

[21] Appl. No.: 715,228

[22] Filed: Mar. 22, 1985

[51] Int. Cl.[4] ..... F04B 47/08

[52] U.S. Cl. ..... 417/404

[58] Field of Search ..... 417/401, 402, 403, 404, 417/396, 397

[56] References Cited

U.S. PATENT DOCUMENTS

| | | | |
|---|---|---|---|
| 2,081,220 | 5/1937 | Coberly | 417/404 |
| 2,119,736 | 6/1938 | Coberly | 417/404 X |
| 3,030,893 | 4/1962 | Shaffer | 417/404 X |
| 4,013,385 | 3/1977 | Peterson | 417/403 X |
| 4,084,923 | 4/1978 | Roeder | 417/404 X |
| 4,202,656 | 5/1980 | Roeder | 417/404 X |
| 4,268,227 | 5/1981 | Roeder | 417/404 X |
| 4,406,598 | 9/1983 | Walling | 417/404 |

*Primary Examiner*—Leonard E. Smith

*Attorney, Agent, or Firm*—Townsend & Townsend

[57] ABSTRACT

A double displacement downhole pump for use in oil wells is provided. The pump comprises a body defining a drive cylinder and pump cylinder which are axially-spaced apart. A drive piston is coupled directly to a pump piston by means of a sleeve connector. The sleeve connector is received on a tension member which extends axially through the pump. The tension member acts to counteract deformity of the sleeve connector during use. The advantage of this construction is that it allows virtually unlimited separation distance between the drive piston and pump piston, which in turn allows a virtually unlimited stroke length for the pump.

1 Claim, 10 Drawing Figures

LONG-STROKE DOWNHOLE PUMP

BACKGROUND OF THE INVENTION

1. Field of the Invention

At on-site oil production locations, hydraulically operated bottom-hole piston pump failure is frequently the result of excessive wear in the valves of the pump and, more frequently in, the precision shuttle valve which controls the motion of the engine piston. The drive fluid to the engine shuttle is often supplied from reconditioned produced reservoir fluids, which can provide minimum lubrication. Since the pistons change stroke directions tens of millions of times a year, the resulting loss of valve integrity causes pump inefficiency, production fall-off, and even shut down.

In response to this problem, long stroke, double displacement piston pumps have been developed. Such long stroke pumps can provide the same volumetric output as the more rapid stroking short pumps but with fewer stroke reversals and less valve wear. However, the simplest double displacement long stroke pumps normally require that the engine piston and pump piston have the same diameter since engine and pump comprise the opposite sides of a single piston.

Under certain circumstances, it is necessary to change the ratio of the pump piston area to engine piston area (referred to as the pressure ratio), particularly when designing pumps for use in deep, low pressure wells. With pumps intended for such wells, it is often necessary to provide a small pump piston relative to the engine piston to increase the driving force of the pump. Conversely, for shallow and/or high pressure wells, it is frequently desirable to increase the area of the pump piston in order to provide for higher volumetric throughput.

To design for pressure ratios less than 1.0 or greater than about 1.15 it is necessary to axially separate the engine and pump pistons in individual cylinders. The pistons are then coupled by a connector rod. In one type of unit, a different diameter pump piston and cylinder than the engine is attached to each end of a double acting engine. The unit becomes very long because of the addition of pump cylinders to each end. Shortening all axial dimensions proportionately for proper fit in the well bottom assembly ultimately compromises the long-stroke feature. In a second type of unit, the engine is located entirely above the pump, and the piston rod alternately undergoes tension and compression depending on the direction in which the pistons are being driven. This type is designed with a short middle rod connector to prevent buckling when it is undergoing an axial compressive force. This unit also has a short stroke.

It would therefore be desirable to provide a single pump design in the shortest possible body, which allows both flexible pressure ratio design as well as a truly double displacement long stroke capability intended for the largest displacement possible. In particular, it would be desirable to provide a double displacement piston pump having an engine piston and pump piston coupled by a connector which is resistant to buckling regardless of its length.

For example, in a well with a lift requirement of 18,000 feet, the required pressure ratio is about 0.5. For a 2½ inch free pump, the number of piston strokes required to produce a barrel of crude oil at these depths ranges from 330 to 733 Strokes per Barrel Liquid (SPBL) depending on the type of industrial pump used. By calculating the displacement of the subject invention in those same length pump bodies, only 162 to 231 SPBL are required. Thus, valve movement and related wear is reduced by about half to one third.

2. Description of the Prior Art

Commercial long-stroke piston pumps are available from the Guiberson Division of Dresser Industries, Houston, Tex. 77005 under the designations Type I and II; from Kobe Division of Trico Industries, Huntington Park, Calif. 92055, under the designation Type E; and from the National Production Systems, Division of National Supply Company, Los Nietos, Calif. 90610.

SUMMARY OF THE INVENTION

The present invention provides an improved double-acting pump having separate, axially-spaced apart engine and pump pistons which are coupled together by a connector sleeve attached at each end to one of the pistons. The connector sleeve, in turn, is slidably mounted on a tension member which runs axially through the pump and is attached at at least one end to the pump body. The other end of the tension member may also be attached to the pump body, or may be attached to a floating piston. In either case, the tension member will undergo tension whenever the connector sleeve undergoes compression. In this way, buckling of the connector sleeve is prevented by the tension member whenever the connector sleeve is under compression.

The pumps of the present invention are particularly suitable for use as downhole oil well or water well pumps where there is limited available space, and which require high volumetric capacity at relatively high pumping pressures combined with minimum maintenance requirements and downtime.

DESCRIPTION OF THE PREFERRED EMBODIMENTS

The pump of the present invention comprises a pump body which is divided into two axially-spaced apart cylinders, referred to as the engine cylinder and the pump cylinder. The engine cylinder houses an engine piston, and the pump cylinder houses a pump piston. The engine piston and the pump piston are connected by a connecting sleeve which is slidably received on a tension member. As the tension member is kept under tension at all times during the compression of the sleeve connector, the sleeve connector is prevented from buckling. The pump is intended to be mounted at the bottom of a well which provides two separate conduits for the supply of a drive fluid to the pump and the return of the pump fluid, typically oil, to the surface. In the preferred embodiment, the well is divided into two concentric conduits, with the central conduit or tubing string carrying drive fluid down to the pump and the annulus between the tubing and casing carrying the pump fluid to the surface.

Figure 1:
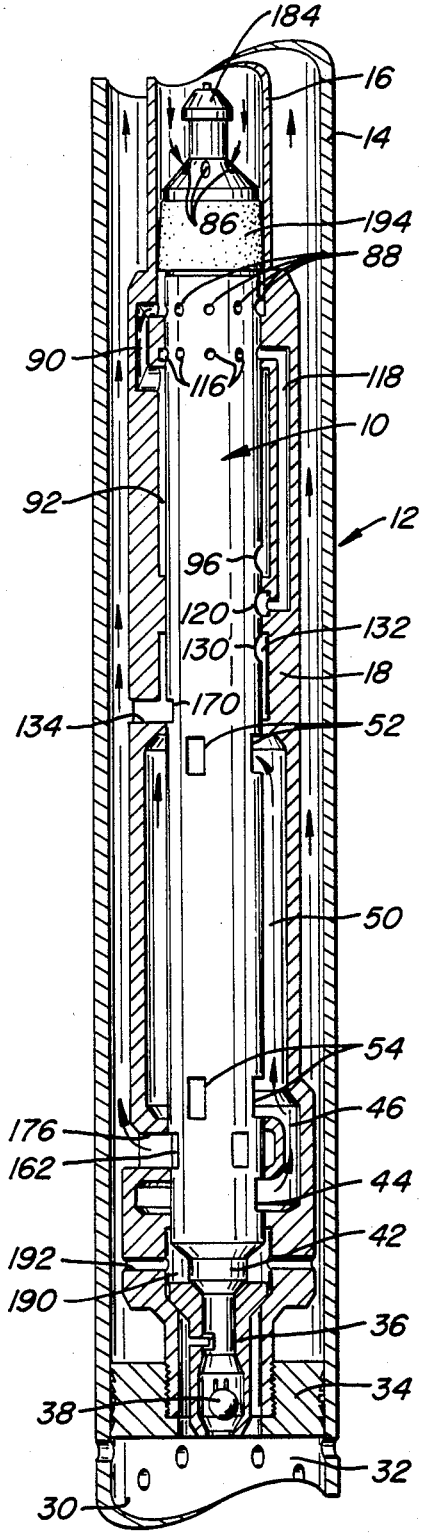
FIG. 1 is an elevational view of a free type pump of the present invention located at the bottom of a well casing, with the well bottom assembly being shown in cross-section.
Figure 2:
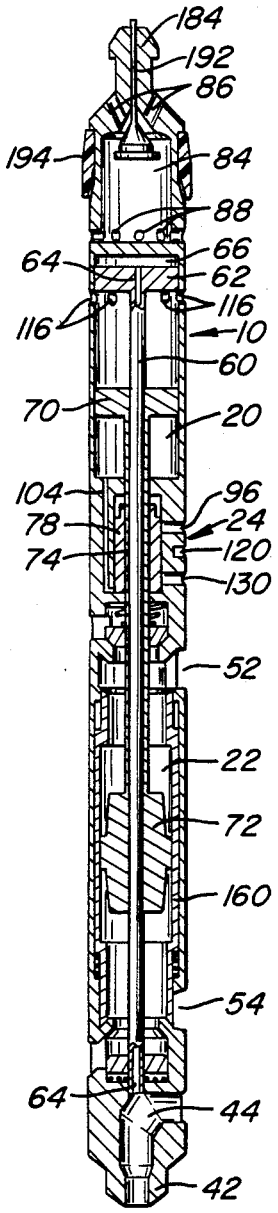
FIG. 2 is an elevational view of the free pump of the present invention shown in cross-section.

Referring now to FIGS. 1 and 2, the general construction and operation of a pump 10 constructed in accordance with the principles of the present invention will be described. In FIG. 1, the pump 10 is depicted at the bottom of a well casing 12 comprising outer and inner conduits 14 and 16, respectively. The tubing or inner conduit 16 terminates at its lower end (all directions are in reference to the figure to which they refer) in a bottom hole assembly 18 which includes various passages which cooperate with ports on pump 10, as will be described in detail hereinbelow.

Pump 10 includes an engine chamber 20 and pumping chamber 22 which are axially-spaced apart and separated by the shuttle piston assembly 24. The details of the shuttle piston assembly 24 are illustrated in FIGS. 3 and 4, and the passages are only generally illustrated in FIG. 2. The purpose of the shuttle assembly 24 is to selectively direct a driving fluid which is fed from tubing 16 to engine chamber 20. The details of such operation are described hereinbelow.

The outer casing 14 of well 12 terminates at its lower end in a perforated inlet screen 30. The inlet screen 30 allows formation (or reservoir) fluid to enter plenum 32 defined by the screen 30 and casing packer 34. Casing packer 34 threadably receives the lower end of bottom hole assembly 18. A retrievable standing valve assembly 36 is positioned at the lower opening of assembly 18 and includes a ball valve 38 which prevents backflow of production fluid from the well casing 12, as will be described hereinafter. Standing valve assembly 36 receives and seats the inlet end 42 of the pump 10.

Inlet end 42 of pump 10 includes inlet passage 44 which directs the flow of production fluid to passage 46 formed in the bottom hole assembly 18. Passage 46, in turn, communicates with chamber 50 in the assembly 18, which chamber circumscribes pump 10 when pump 10 is properly located and seated in assemblies 18 and 36. Chamber 50 allows incoming reservoir fluid to flow into upper inlet ports 52 and lower inlet ports 54, as will be described in detail hereinafter.

Pump 10 includes an axial tension member 60 which is secured at its lower end to the inlet end 42 of the pump. At its upper end, tension member 60 terminates in a free floating piston 62 which is located at the upper end of the engine chamber 20. The upper surface of piston 62 is continuously exposed to the production fluid pressure by communication through ports 64 and passage 66 in well bottom assembly 18. Thus, when pressure in engine chamber 20 below piston 62 exceeds the production fluid pressure, piston 62 will be urged upward, placing tension member 60 under tension during the downstroke.

The pump 10 operates by means of an engine piston 70 which is coupled to a pump piston 72 by a connector sleeve 74. Connector sleeve 74 is slidably mounted on the tension member 60 with engine piston 70 located in engine chamber 20 and pump piston 72 located in pumping chamber 22. In this way, the engine piston 70, pump piston 72, and connector sleeve 74 are able to reciprocate as a unit, and the pump may be operated by directing a pressurized drive fluid on alternate sides of the engine piston 70 in engine cylinder 20. Flow of the drive fluid is controlled by the shuttle piston assembly 24 located between the engine chamber 20 and pumping chamber 22.

Figure 3A:
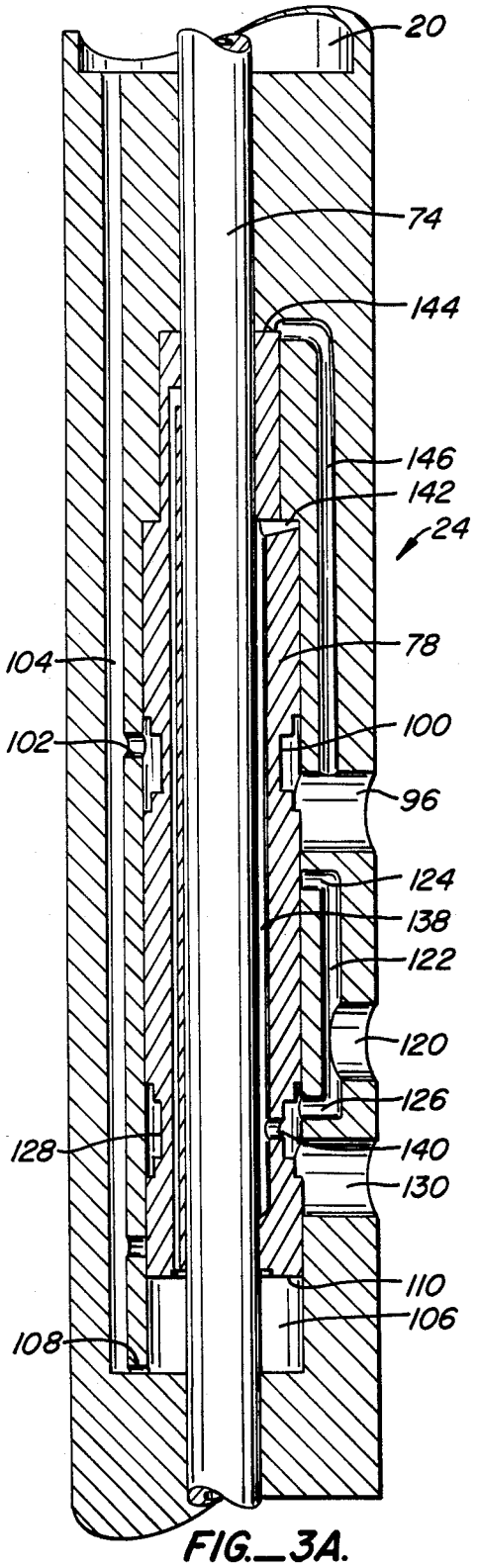
FIGS. 3A and 3B are detailed, cross-sectional views of the shifting valve of the pump of the present invention, which shifting valve reverses the flow of drive fluid to the engine piston. The shifting valve is illustrated in the position corresponding to the upstroke of the engine piston.
Figure 3B:
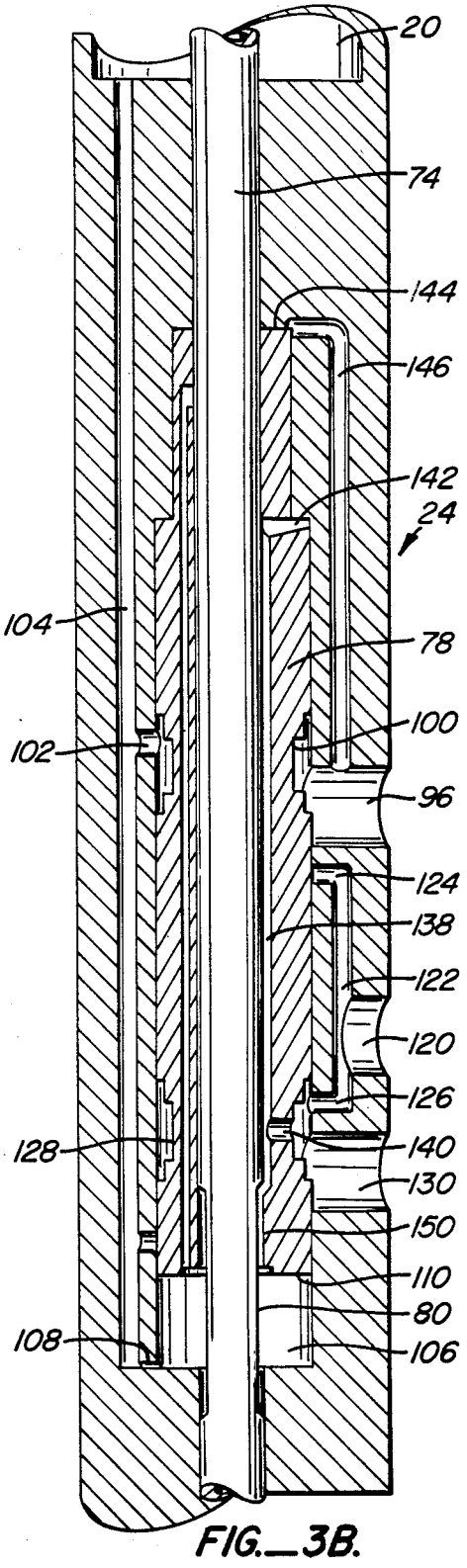
Figure 4A:
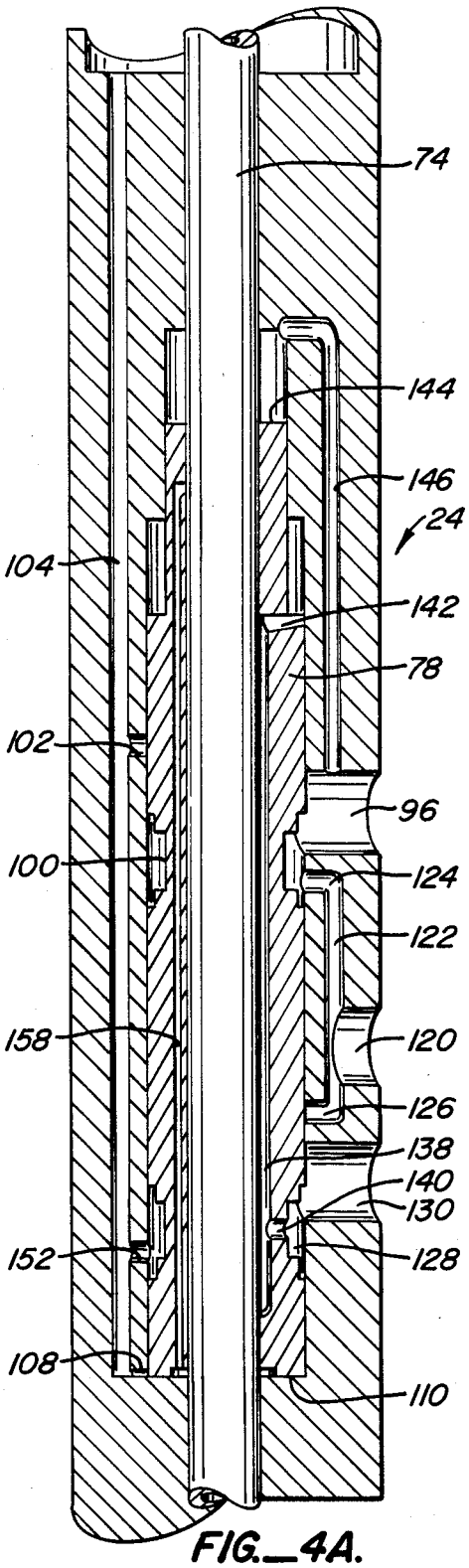
FIGS. 4A and 4B are identical to FIGS. 3A and 3B, except that the shifting valve is illustrated in the position corresponding to the downstroke of the engine piston.
Figure 4B:
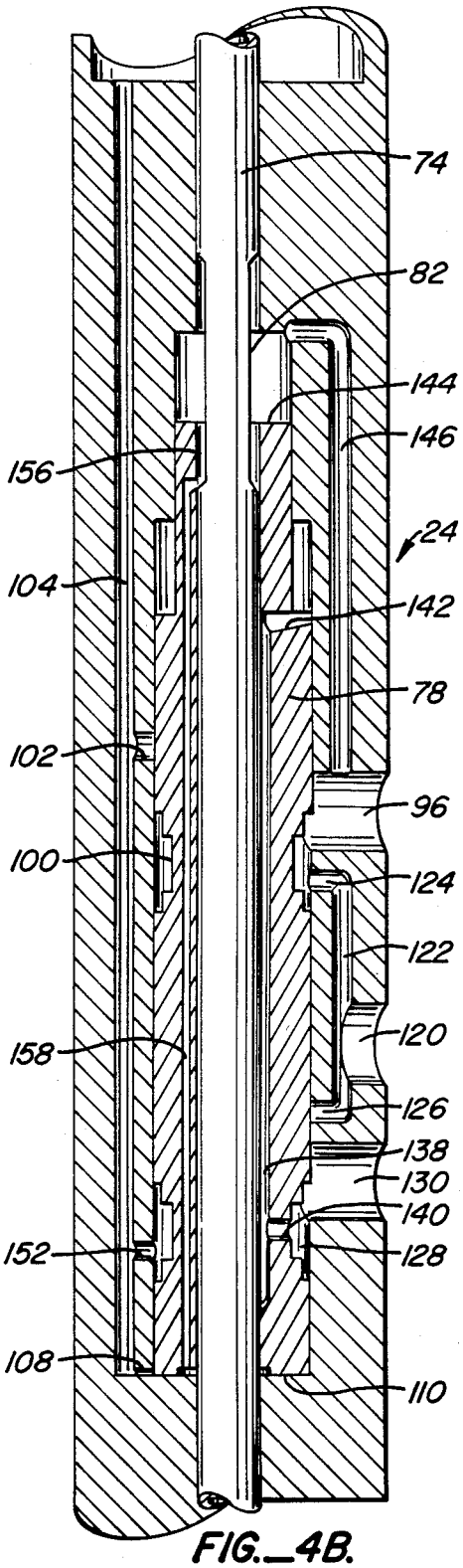

Referring now in particular to FIGS. 1, 3 and 4, the construction and operation of the shuttle piston assembly 24 will be described in detail. The shuttle piston assembly 24 comprises only two moving parts which cooperate to direct the flow of drive fluid alternately above and below engine piston 70 in engine chamber 20, as well as to exhaust drive fluid from the opposite side of the piston 70. The two moving parts are a shuttle piston 78 and the connector sleeve 74. Connector sleeve 74 includes two annular recesses 80 (FIG. 3B) and 82 (FIG. 4B) which alter the pressure distribution on the shuttle piston 78 in a manner which causes the piston to shift from its upward position (FIGS. 3A and 3B) to its downward configuration (FIGS. 4A and 4B). In its upward configuration, piston 78 directs pressure to the underside of piston 70, causing both the engine piston 70 and pump piston 72 to move upward. Conversely, in its downward position, shuttle piston 78 directs the drive fluid to the top side of piston 70, causing both piston 70 and pump piston 72 to move downward.

Drive fluid reaches pump 10 through inner conduit 16 and enters into chamber 84 (FIG. 2) through ports 86. The drive fluid exits chamber 84 through ports 88 and enters passage 90 (FIG. 1) in well bottom assembly 18. Passage 90 is connected to chamber 92 which forms an annulus about a portion of the exterior of pump 10. The drive fluid enters the shuttle piston assembly 24 through inlet port 96 which is positioned near the bottom of chamber 92 when the pump is properly positioned in bottom hole assembly 18.

Referring now in particular to FIGS. 1, 2 and 3A, the manner in which drive fluid is directed to the underside of piston 70 will be described. Shuttle piston 78 includes a first annular channel 100 which is aligned with inlet port 96 when piston 78 is in its upward position. Drive fluid is thus able to flow around the path defined by channel 100 to a port 102 which leads to a vertical passage 104 defined in the pump body. Vertical passage 104 is open at its upper end to the bottom of drive cylinder 20. Thus, high pressure drive fluid is able to enter engine chamber 20 on the underside of the engine piston 70, causing engine piston 70 to rise.

Vertical passage 104 is also open through passage 108 to a chamber 106 formed at the lower end of shuttle piston 78. Thus, during the upstroke of the pump, chamber 106 will be filled with high pressure drive fluid which exerts an upward force against lower face 110 of the shuttle piston 78.

As drive piston 70 moves upward, drive fluid on the topside of piston 70 must be expelled from engine chamber 20. A plurality of ports 116 (FIGS. 1 and 2) are formed at the upper end of cylinder 20 and are in communication with vertical passage 118 formed in the well bottom assembly 18. Vertical passage 118 directs the exhaust drive fluid to port 120 in pump 10. Port 120, in turn, is connected to passage 122 (FIGS. 3A and 3B) having two branches 124 and 126. With the shuttle piston 78 in its upper position, branch 124 is blocked and branch 126 is open to an annular recess 128 formed in the piston 78. Annular recess 128 allows exhaust drive fluid to flow from port 120 to an exhaust port 130. Exhaust port 130 is open to chamber 132 (FIG. 1) formed between pump 10 and the well bottom assembly 18. Chamber 132 opens through port 134 formed in the bottom hole assembly 18. Port 134 allows the exit of both exhaust drive fluid as well as production fluid from the pump cylinder, as will be described in more detail hereinafter.

Annular recess 128 is connected to a rifled passage 138 (FIGS. 3A and 3B) through port 140. Thus, low (exhaust) pressure will be exerted against shoulder 142 on the top of piston 78 during the upstroke of the pump. The force created by this low pressure, even when combined with the high pressure present on face 144 (as a result of connection with high pressure inlet 96 by means of passage 146), is insufficient to overcome the force created by the high pressure against face 110. Thus, so long as the shuttle piston 78 and connector sleeve 74 are in the position shown in FIG. 3A, the shuttle piston 78 will remain in the upper position.

As engine piston 70 and pump piston 72 reach the upper extent of their travel, however, recess 80 on connector sleeve 74 reaches the lower end of shuttle piston 78 (FIG. 3B). Recess 80 defines a new passage 150 which connects the low pressure exhaust port 120 with chamber 106. This connection allows the high pressure in chamber 106 to bleed, thus reducing the upward force against face 110 of the shuttle piston 74. As soon as such upward force decreases below the combined downward forces against shoulder 142 and face 144, as described above, the shuttle piston will move in the downward direction until it reaches the position illustrated in FIG. 4A. This shift in position causes a realignment of the various passages which have been described, which redirects the drive fluid to the topside of piston 70, as will now be described.

Referring now in particular to FIGS. 1, 2 and 4A, high pressure drive fluid is still directed to inlet port 96, as previously described. Annular recess 100, however, has shifted downward and is no longer in communication with port 102. Instead, annular recess 100 connects inlet port 96 with branch 124 of passage 122. Thus, high pressure drive fluid is directed to port 120 which is connected to ports 116 (FIG. 1) at the upper end of engine cylinder 20 by passage 118.

The underside of piston 70 (FIG. 2) is now open to the exhaust port 130, as will now be described. Vertical passage 104 (FIG. 4A) is connected to annular recess 128 by port 152. Port 152, in turn, is directly open to port 130. Rifled passage 138 is connected to the low pressure exhaust drive fluid by port 140 in recess 128.

As illustrated in FIG. 4A, pressure is exerted on shuttle piston 78 to maintain the shuttle piston in its lowered position. High pressure is exerted against face 144 at the upper end of piston 78 by passage 146 which is connected to high pressure drive fluid inlet 96. Low (exhaust) pressure is exerted against both shoulder 142 and face 110. Shoulder 142 is open to the low pressure by means of the rifled passage 138, as just described. Face 110 is open to the low pressure through vertical passage 104 and passage 108.

Referring now in particular to FIG. 4B, the position of the shuttle piston 78 is shifted as the engine piston 70 and pump piston 72 reach the lowermost extent of their travel. The recess 82 formed in sleeve connector 74 reaches the position illustrated in FIG. 4B, defining a passage 156 connecting the high pressure in the chamber above face 144 with passage 158 which terminates at the lower face 110 of the piston 78. Thus, high pressure will be exerted against face 110. Since the area of face 110 exceeds that of face 144, the upward force on piston 78 will exceed the downward forces on face 144 and shoulder 142, and the piston 78 will be caused to rise. Once the piston 78 rises, it will assume the configuration illustrated in FIG. 3A, and the pump cycle will begin anew.

Referring now to FIGS. 1, 2 and 5, the pumping action of pump 10 will be described in detail. Pump piston 72 is located within a shifting cylinder 160 which defines the side of the pumping chamber 22. As illustrated in FIG. 5A, pump piston 72 is beginning its downstroke with production fluid being driven out of outlet port 162 at the lower end of pump chamber 22. Shifting cylinder 160 is in its lowered position, which results in blockage of inlet port 54 and opening of inlet port 52. Thus, reservoir fluid will be able to enter pumping chamber 22 from chamber 50 (FIG. 1) through port 52 as the pump piston 72 travels downward. Ring valve 168 isolates pumping chamber 22 from outlet port 170, while ring valve 172 is open to allow the release of production fluid through outlet port 162. Both ring valves 168 and 172 are spring-mounted to assure that they close whenever pump piston 72 ceases to move. The production fluid exiting from port 162 passes through port 176 (FIG. 1) formed in well bottom assembly 18 and out into the annular space between casing 14 and tubing 16. The production fluid travels to the surface through this annulus.

Figure 5A:
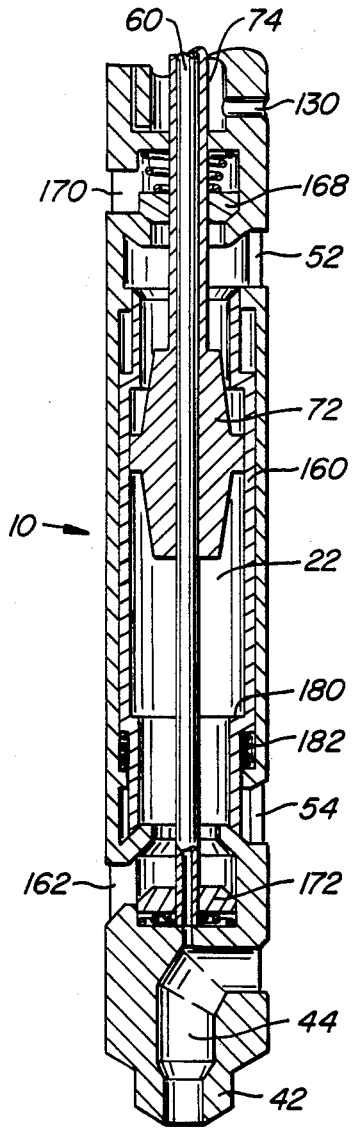
FIGS. 5A–5D are elevational views of the pump cylinder and piston of the present invention, illustrating the flow paths on both the upstroke and the downstroke.
Figure 5B:
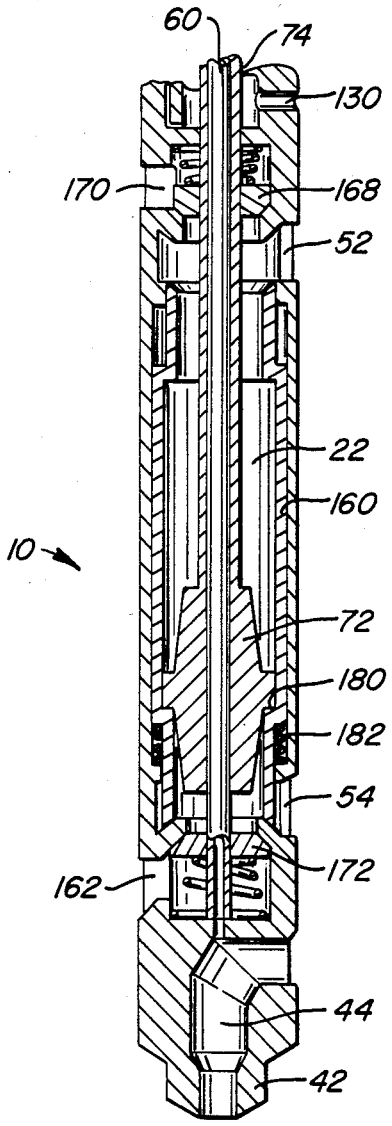
Figure 5C:
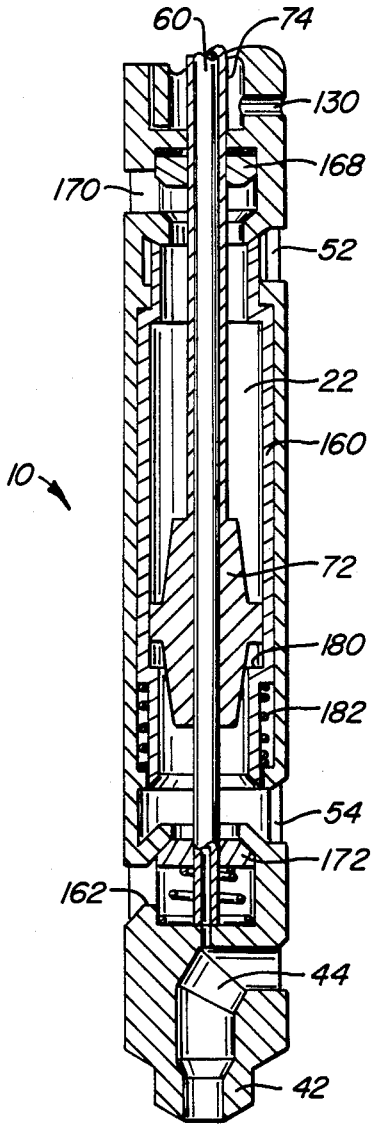

Throughout the downstroke of pump piston 72, high pressure maintained against shoulder 180 formed in the interior of shifting cylinder 160 holds the shifting cylinder in the downward position. The situation continues until pump piston 72 reaches its lowermost extent of travel, as illustrated in FIG. 5B. At that point, the direction of travel of piston 72 is reversed (as described hereinabove in connection with the shuttle piston assembly) and ring valve 172 springs closed allowing low pressure on shoulder 180. As soon as piston 72 begins to travel upward, shifting cylinder 160 moves upward under the influence of spring 182, plus the stick start friction of piston 72 on shifting cylinder 160. The movement of shifting cylinder 160 opens inlet port 54, allowing production fluid from chamber 46 to enter the lower half of pumping chamber 22 (FIG. 5C). The production fluid in the upper half of cylinder 22, which had been drawn in on the previous downstroke, is pumped out of the cylinder through outlet port 170. Ring valve 168 is opened by the increased pressure caused by the raising of the pump piston 72.

Figure 5D:
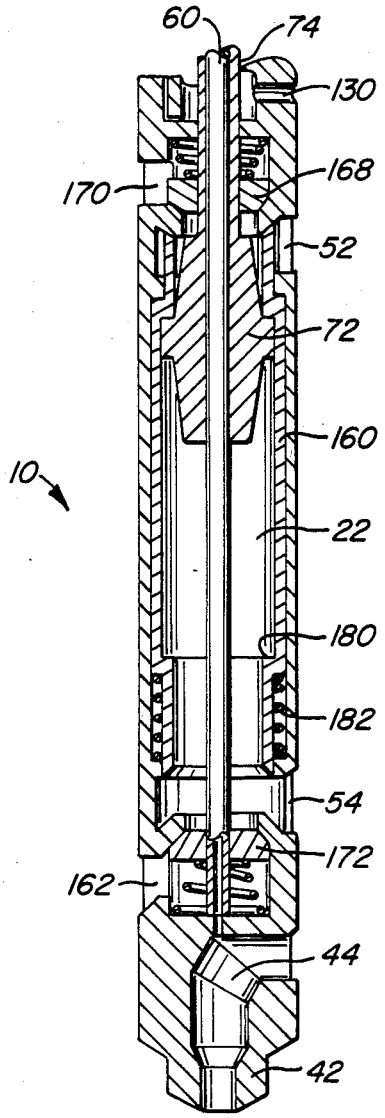

Pump piston 72 continues rising until it reaches the upper extent of its travel, as illustrated in FIG. 5D. The direction of travel is then reversed, and the pumping cycle is renewed.

Pump 10 is hydraulically lowered into position in the tubing conduit 16 of well casing 12 by conventional free pump means. A fishing neck 184 (FIGS. 1 and 2) is provided for well head insertion and lift-out of the pump 10. Removal of the pump 10 from well bottom assembly 18 is accomplished by reversing the fluid flow through the system. That is, hydraulic fluid is pumped down the annulus between the tubing 16 and casing 14 so that it enters the chamber 190 at the bottom of pump 10 through a passage 192 (FIG. 1). The pressure on the bottom of the pump causes the pump to rise. Fluid bypass around the pump 10 is prevented by nose valve 192 and swab cup 194. Nose valve 192 raises upward to close ports 86, and swab cup 194 flexibly and slidably seals against the inner cylindrical wall of tubing 16. Free pump 10 is circulated up to the well head where it is lifted from the well.

During the downstroke of the engine piston 70 and pump piston 72, the connector sleeve 74 will undergo compression. In the prior art, it has been found that such compression tends to deform piston rods which have been used to connect pump pistons to engine pistons. The present invention, in contrast, provides the axial tension member 60 to prevent such deformation. During the stroking of the pump, pressure in engine chamber 20 is exerted against the underside of floating piston 62. This places the tension member 60 under tension, causing the member 60 to remain straight. The connector sleeve travels on the tension member 60 and receives support therefrom. By virtue of this construction, the drive piston 70 and pump piston 72 may be separated by virtually unlimited distances, allowing for very long stroke lengths, even at very high pressures.

Although the foregoing invention has been described in some detail by way of illustration and example for purposes of clarity of understanding, it will be obvious that certain changes and modifications may be practiced within the scope of the appended claims.

What is claimed is:

1. An improved double-acting pump of the type including:

a pump body defining an engine chamber capable of receiving a drive fluid and a pump chamber capable of receiving and discharging a production fluid, said engine and pump chambers being axially-spaced apart;

an engine piston mounted to reciprocate within the engine cylinder under force of the drive fluid; and a pump piston mounted within the pump chamber and mechanically coupled to the drive piston to reciprocate therewith;

whereby the fluid to be pumped is drawn into and discharged from the pump chamber;

said improvement being an improved means for mechanically coupling the engine and pump pistons comprising:

a tension member running axially through both the pump chamber and the engine, tension member being fixed to the pump body in the pump chamber and terminating in a floating piston in the engine chamber, whereby pressure in the engine chamber exerts a tensile force on the tension member; and a connector sleeve slidably mounted on the tension member and having the pump piston mounted at one end thereof and the engine piston mounted at the other end thereof, whereby the tension member prevents buckling of the sleeve under compression.

* * * * *